US005530969A

United States Patent [19]

Lewandowski

[11] Patent Number: 5,530,969

[45] Date of Patent: Jul. 2, 1996

[54] METHOD FOR PROVIDING A T-SHIRT HAVING A CONFIGURATION RESEMBLING THAT OF A FORTUNE COOKIE

[76] Inventor: Brian C. Lewandowski, 39310 Lembke, Sterling Heights, Mich. 48313

[21] Appl. No.: 489,110

[22] Filed: Jun. 9, 1995

[51] Int. Cl.[6] ..... A41B 1/00

[52] U.S. Cl. ..... 2/115; 2/243.1

[58] Field of Search ..... 2/115, 1, 243.1, 2/106, 108, 85, 93; 428/542.2, 542.6; 493/937, 938

*Primary Examiner*—C. D. Crowder
*Assistant Examiner*—Gloria Hale
*Attorney, Agent, or Firm*—Peter D. Keefe

[57] ABSTRACT

A method for imparting a fortune cookie appearance upon a T-shirt. The T-shirt has imprinted thereupon a "fortune" message, such as "Tomorrow will be your lucky day." The T-shirt is manipulated so that the finished look resembles as closely as possible the shape of a true fortune cookie as it is commonly seen and enjoyed in Chinese restaurants. There are two basic methods to take a T-shirt and make it look like a fortune cookie. A first method provides an appearance like that of a fortune cookie, wherein the clam-shell of the fortune cookie appears fully closed (whereupon the printed paper message "fortune" thereof is supposedly contained fully thereinside). A second method provides an appearance like that of a fortune cookie wherein end portions of the paper fortune is exposed, wherein the sleeves of the T-shirt seem to be like end portions of a printed paper "fortune" extending outwardly from the clam-shell of the fortune cookie.

20 Claims, 3 Drawing Sheets

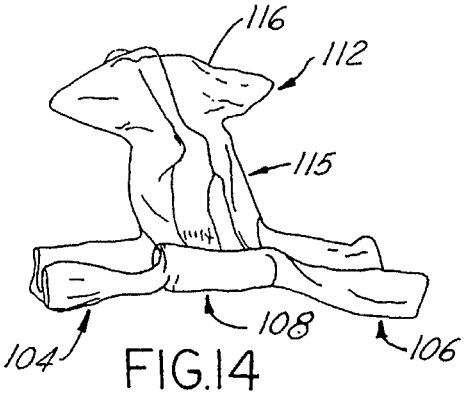
FIG.14
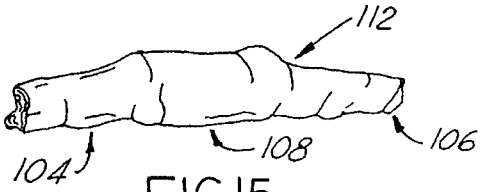
FIG.15
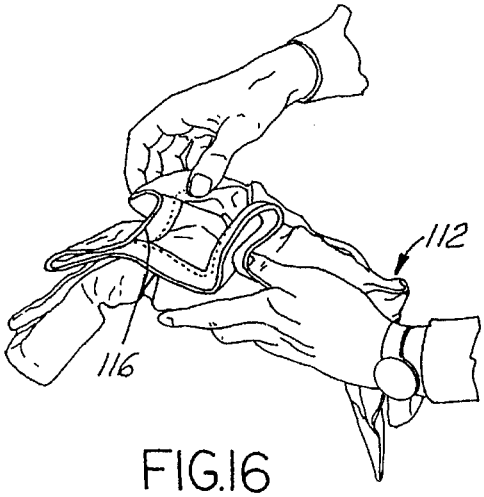
FIG.16
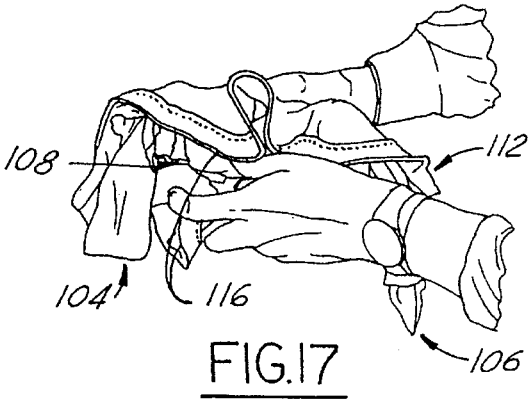
FIG.17
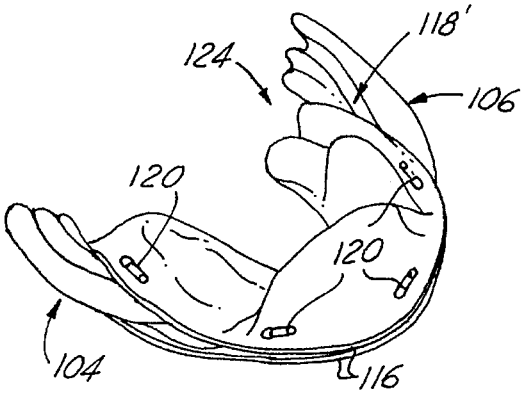
FIG.18
FIG.19
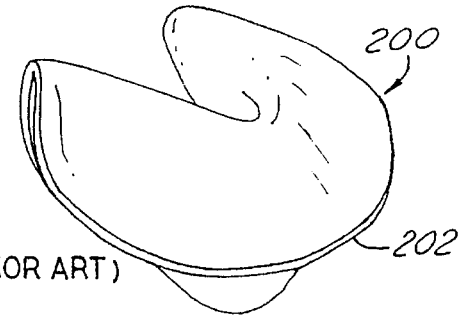
(PRIOR ART)

METHOD FOR PROVIDING A T-SHIRT HAVING A CONFIGURATION RESEMBLING THAT OF A FORTUNE COOKIE

BACKGROUND OF THE INVENTION

1. Field of the invention

The present invention relates to both T-shirts and fortune cookies. More particularly, the present invention relates to a method for folding a T-shirt so that it acquires a configuration that resembles a fortune cookie.

2. Description of the Prior Art

Fortune cookies are well known in the food art associated with Chinese food. As depicted by FIG. 19, a fortune cookie has an acutely folded clam-shell like appearance. Fortune cookies include an internally disposed "fortune" message printed on paper for the possessor who opens the fortune cookie to find and enjoy. One of the enjoyments is the sharing of the fortune message with companions at the dinner table.

T-shirts typically are collarless, short-sleeved shirts frequently made of cotton material. T-shirts have now become quite ubiquitous as a staple item of attire, both as an undershirt and as an outer garment for both men and women.

What would be novel and interesting is if somehow T-shirts could acquire a fortune cookie configuration, whereby the sale and giving of T-shirts would be far more exciting and enjoyable than that associated with conventionally folded or unfolded T-shirts.

SUMMARY OF THE INVENTION

The present invention is a .method for configuring a T-shirt to resemble a fortune cookie. The T-shirt may or may not include a written "fortune" printed thereupon, but it is preferred for the T-shirt to have a fortune printed thereupon.

A first method according to the present invention provides a T-shirt having a fortune cookie appearance wherein the "fortune" is not visible, as follows:

A selected T-shirt is laid flat upon a surface with the sleeves opposingly outstretched on the surface;

the body of the T-shirt is vertically folded over itself a small, preselected amount;

the trunk portion of the body is gathered inwardly, while the waist portion of the T-shirt is left ungathered;

the T-shirt is then vertically folded wherein one sleeve is superposed the other;

the sleeves are then folded over onto the body;

the T-shirt is then rolled starting from the neck toward the waist portion;

the waist portion is then opened and wrapped around the body to thereby form a clam-shell appearance to the T-shirt;

the waist end of the T-shirt is then preferably secured together, such as by three or four mutually spaced apart safety pins;

lastly, the clam-shell is acutely folded to thereby cause the T-shirt to resemble a fortune cookie.

A second method according to the present invention provides a T-shirt having a fortune cookie appearance wherein the "fortune" appears to extend outwardly from either end thereof, as follows:

A selected T-shirt is laid flat upon a surface with the sleeves opposingly outstretched on the surface;

the body of the T-shirt is vertically folded over itself a preselected amount;

the trunk portion of the body is gathered inwardly, while the waist portion of the T-shirt is left ungathered and the sleeves remain outstretched;

the T-shirt is then rolled starting from the neck toward the waist portion;

the waist portion is then opened and wrapped around the body to thereby form a clam-shell appearance to the T-shirt, wherein the sleeves extend outwardly at either end thereof;

the waist end of the T-shirt is then preferably secured together, such as by three or four mutually spaced apart safety pins;

lastly, the clam-shell is acutely folded to thereby cause the T-shirt to resemble a fortune cookie with the "fortune" message paper seeming to extend partly out from either end thereof.

Accordingly, it is an object of the present invention to provide a T-shirt with a configuration that resembles a fortune cookie.

It is a further object of the present invention to provide a T-shirt with a configuration that resembles a fortune cookie, wherein a "fortune" is printed upon the body of the T-shirt.

These, and additional objects, advantages, features and benefits of the present invention will become apparent from the following specification.

BRIEF DESCRIPTION OF THE DRAWINGS

FIGS. 13 through 18 depict views of a selected T-shirt being subjected to progressive folding steps according to a second method for providing a T-shirt with a fortune cookie appearance.

FIG. 19 is a perspective view of a prior art fortune cookie.

DETAILED DESCRIPTION OF THE PREFERRED EMBODIMENT

Figure 1:
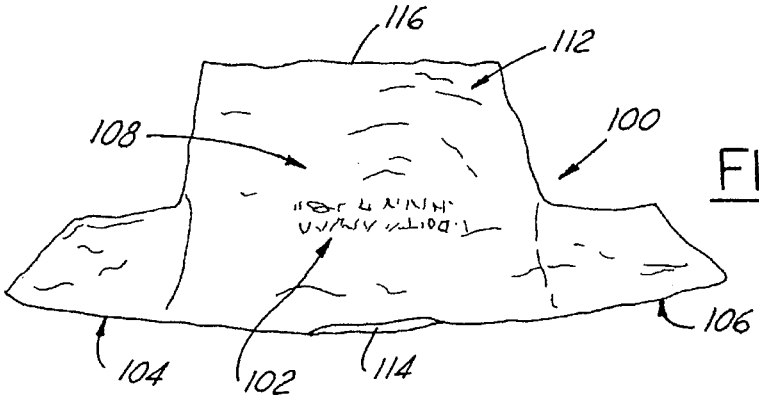
FIGS. 1 through 12 depict views of a selected T-shirt being subjected to progressive folding steps according to a first method for providing a T-shirt with a fortune cookie appearance.

Referring by way of comparison to FIGS. 1 and 19, it is to be understood that the intent of the present invention is to provide a common, conventional T-shirt 100 with the novelty, excitement and unique look of a fortune cookie 200. In this regard, in order to complete the fortune cookie impression, the T-shirt 100 preferably has imprinted thereupon a "fortune" message 102, such as "Tomorrow will be your lucky day." Further in this regard, the finished manipulation of the T-shirt 100 should resemble as closely as possible the shape of a true fortune cookie 200 as it is commonly seen and enjoyed in Chinese restaurants.

There are two basic methods to take a common T-shirt 100 and make it look like a fortune cookie. A first method provides an appearance like that of a fortune cookie 200, wherein the clam-shell 202 of the fortune cookie appears fully closed (whereupon the printed paper message "fortune" thereof is supposedly contained fully thereinside). A second method provides an appearance like that of a fortune cookie similar to that depicted in FIG. 19, but where the sleeves 104, 106 of the T-shirt 100 seem to be like end portions of a printed paper "fortune" extending outwardly from the clam-shell of the fortune cookie.

With regard to the first method, the following steps are undertaken according to the present invention.

Figure 2:
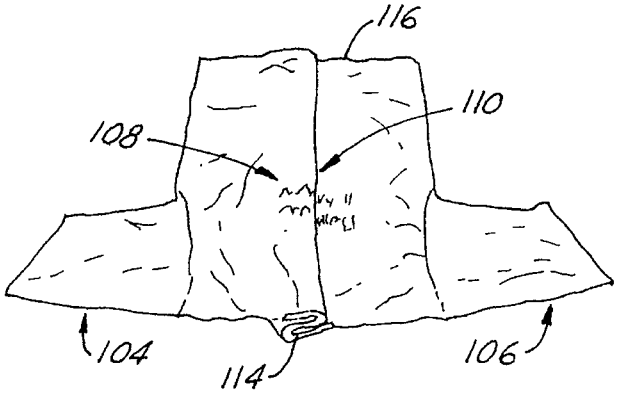
Figure 3:
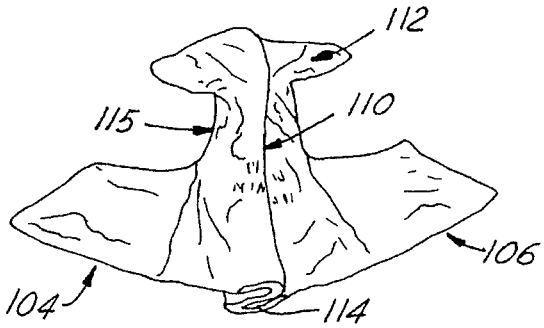
Figure 4:
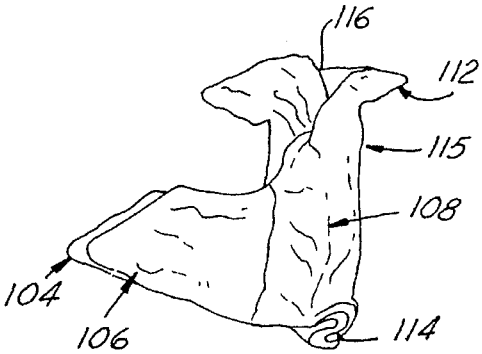
Figure 5:
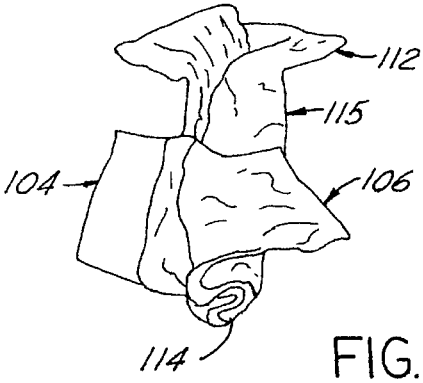
Figure 6:
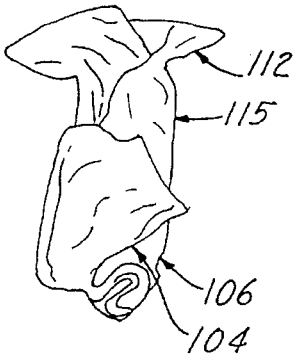

The T-shirt 100 is laid flat upon a surface with the sleeves 104, 106 opposingly outstretched on the surface, as shown by FIG. 1. Next, as shown by FIG. 2, the body 108 of the T-shirt 100 is provided with a vertical fold 110 which is performed over itself a small, preselected amount, The vertical folding is optional and may be obviated for small size T-shirts. As FIG. 3 depicts, the trunk portion 115 of the body 108 is now gathered inwardly, while the waist portion 112 of the T-shirt 100 is left ungathered. The T-shirt 100 is then vertically folded wherein one sleeve 104 is superposed the other sleeve 106, as shown by FIG. 4. Next, as FIGS. 5 and 6 progressively depict, the sleeves 104, 106 are then folded over onto the body 108.

Figure 7:
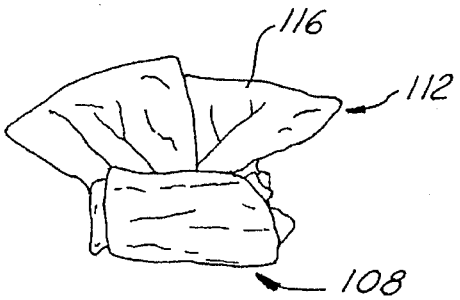
Figure 8:
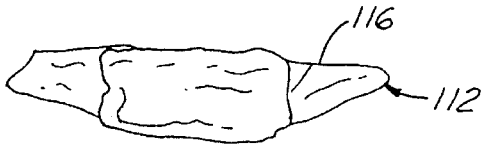
Figure 9:
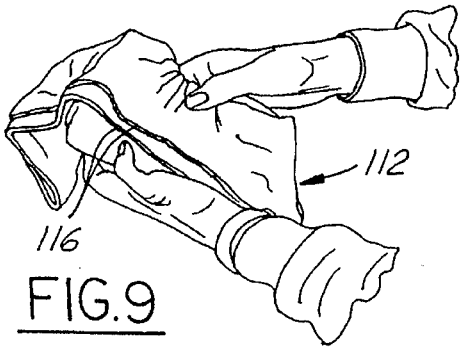
Figure 10:
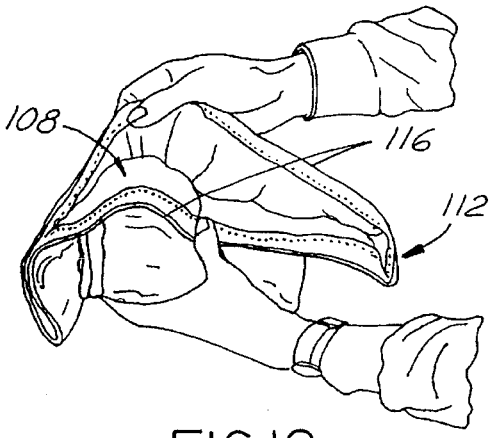

As shown progressively by FIGS. 7 and 8, the T-shirt 100 is then rolled starting from the neck 114 toward the waist portion 112. Now, as shown progressively by FIGS. 9 and 10, the T-shirt 100 is grasped by both hands of a person who then effects to pull on the waist end 116 of the T-shirt 100 to thereby cause the waist portion 112 to be peeled around the body 108 to thereby provide an appearance of the T-shirt similar to a clam-shell 118.

Figure 11:
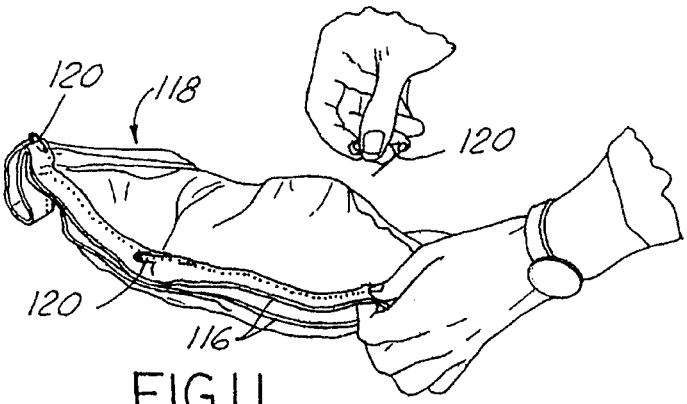
Figure 12:
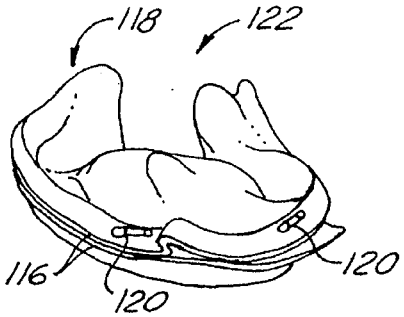

Next, as shown by FIG. 11, the waist end 116 is closed together. In this regard, it is preferable for the waist end 116 to then be secured together, such as by the piercing installation of three or four mutually spaced apart safety pins 120. While securing the waist end is not mandatory, it is preferred in order to ensure the waist end stays closed and to prevent the clam-shell 118 from unraveling during handling; however, the prior folding steps result in a clam-shell that has inherent resistance to unraveling. Finally, the clam-shell 118 is acutely folded as depicted by FIG. 12 to thereby cause the T-shirt 100 to become a fortune cookie T-shirt 122 which resembles a real fortune cookie 200.

Now, when a person receives the fortune cookie T-shirt 122 according to the present invention, there will be much excitement over the novelty of the presentation configuration thereof, as well as the unknown and wonderful printed fortune 102 which will be found when the fortune cookie T-shirt 122 is opened by releasing the safety pins 120 and unfolding it. Since one of the best features of a fortune cookie is the sharing of the fortune with others, the owner will thereafter undoubtedly proudly wear the T-shirt 100, knowing that onlookers will be excited to read the fortune 102.

With regard to the second method, the following steps are undertaken according to the present invention.

Figure 13:
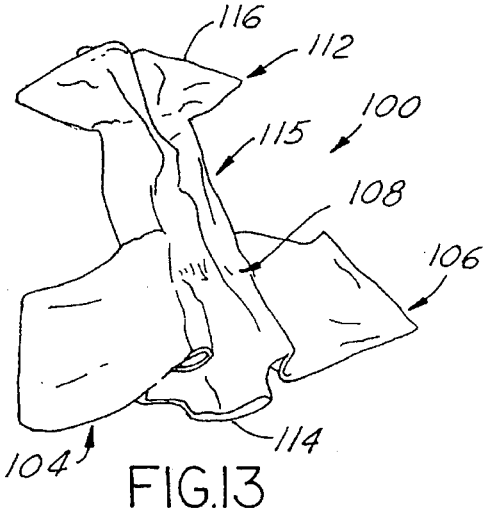

As hereinabove mentioned with respect to the first method, the T-shirt 100 is laid flat upon a surface with the sleeves 104, 106 opposingly outstretched on the surface, as shown by FIG. 1. Next, as shown by FIG. 13, the body 108 of the T-shirt 100 is provided with a vertical fold 110 which is performed over itself a preselected amount. The vertical folding is optional, but it is more important to select an optimal transverse width of the body than with the first method, since if the body is more transversely compact, a more pleasing projection of the sleeves will be noted when the steps herein are completed. As FIG. 13 further depicts, the trunk portion 110 of the body 108 is also gathered inwardly, while the waist portion 112 of the T-shirt 100 is left ungathered.

With the sleeves 104, 106 yet remaining outstretched on the surface, the T-shirt 100 is then rolled starting from the neck 114 toward the waist portion 112, as shown progressively by FIGS. 14 and 15. Now, as shown progressively by FIGS. 16 and 17, the T-shirt 100 is grasped by both hands of a person who then effects to pull on the waist end 116 of the T-shirt 100 to thereby cause the waist portion 112 to be opened and wrapped around the body 108 to thereby provide an appearance of the T-shirt similar to a clam-shell 118', wherein the sleeves 104, 106 "hang-out" respectively, at opposing ends of the clam-shell.

Next, the waist end 116 is then closed together. In this regard, preferably the waist end 116 is secured together, such as by the piercing installation of three or four mutually spaced apart safety pins 120. While securing the waist end is not mandatory, it is preferred in order to ensure the waist end stays closed and to prevent the clam-shell 118' from unraveling during handling; however, the prior folding steps result in a clam-shell that has inherent resistance to unraveling. Finally, the clam-shell 118' is acutely folded as depicted by FIG. 18 to thereby cause the T-shirt 100 to become a fortune cookie T-shirt 124 which resembles a real fortune cookie having portions of the fortune paper projecting form opposing ends thereof.

Now, as with the first method recounted hereinabove, when a person receives the fortune cookie T-shirt 124 according to the present invention, there will be much excitement over the novelty of the presentation configuration thereof, as well as the unknown and wonderful printed fortune 102 which will be found when the fortune cookie T-shirt 124 is opened by releasing the safety pins 120, if present, and unfolding it. Since one of the best features of a fortune cookie is the sharing of the fortune with others, the owner will thereafter undoubtedly proudly wear the T-shirt 100, knowing that onlookers will be excited to read the fortune 102.

It is to be understood, that while acutely folding the clam-shell is desirable to provide a "perfect" fortune cookie look-alike, this step is not required as the clam-shell look is generally sufficient in many cases to suffice as a fortune cookie appearance.

Further, while the above recounted methods are preferred, the present invention can be performed generally under the foregoing illustrated steps as follows:

printing a fortune message on a selected T-shirt;

placing the T-shirt flat upon a surface;

selectively orienting the sleeves thereof in one of an outstretched orientation wherein the sleeves are opposingly outstretched on the surface and a folded orientation wherein the sleeves are folded over onto the body of the T-shirt;

gathering inwardly the trunk portion of the body while the waist portion of the T-shirt is left ungathered;

rolling the T-shirt starting from the neck toward the waist portion;

opening and wrapping the waist portion around the body to thereby form a clam-shell appearance to the T-shirt; and closing and securing together the waist end of the T-shirt.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A method for configuring a T-shirt to resemble a fortune cookie, the T-shirt having a body, the body having a trunk portion, a waist portion and a waist end, the T-shirt further having a first sleeve, a second sleeve and a neck, said method comprising the steps of:

placing a selected T-shirt flatly upon a surface with the first and second sleeves thereof opposingly outstretched on the surface;

gathering inwardly the trunk portion of the body of the T-shirt, while the waist portion of the T-shirt is left ungathered;

vertically folding the T-shirt wherein the first sleeve is superposed the second sleeve;

folding the first and second sleeves over onto the body;

rolling the T-shirt starting from the neck toward the waist portion;

opening and wrapping the waist portion around the body to thereby form a clam-shell appearance to the T-shirt; and closing together the waist end of the T-shirt.

2. A T-shirt product made according to the method of claim 1.

3. The method of claim 1, further comprising the step of securing together the waist end of the T-shirt.

4. The method of claim 1, further comprising, after said step of placing, the step of vertically folding the body of the T-shirt over onto itself a small, preselected amount

5. The method of claim 1, further comprising the step of printing a fortune message on the T-shirt.

6. A T-shirt product made according to the method of claim 5.

7. The method of claim 1, further comprising, after said step of closing, the step of acutely folding the clam-shell.

8. The method of claim 3, further comprising, after said step of placing, the step of vertically folding the body of the T-shirt over onto itself a small, preselected amount; the step of printing a fortune message on the T-shirt; and after said step of securing, the step of acutely folding the clam-shell.

9. A T-shirt product made according to the method of claim 8.

10. A method for configuring a T-shirt to resemble a fortune cookie, the T-shirt having a body, the body having a trunk portion, a waist portion and a waist end, the T-shirt further having a first sleeve, a second sleeve and a neck, said method comprising the steps of:

placing a selected T-shirt flat upon a surface with the sleeves thereof opposingly outstretched on the surface;

gathering inwardly the trunk portion of the body of the T-shirt while the waist portion of the T-shirt is left ungathered and the first and second sleeves remain outstretched;

rolling the T-shirt starting from the neck toward the waist portion;

opening and wrapping the waist portion around the body to thereby form a clam-shell appearance to the T-shirt, wherein the first and second sleeves extend outwardly at either end thereof; and closing together the waist end of the T-shirt;

wherein the first and second sleeves of the T-shirt resemble a fortune cookie with the "fortune" message paper extending partly out from either end thereof.

11. A T-shirt product made according to the method of claim 10.

12. The method of claim 10, further comprising the step of securing together the waist end of the T-shirt.

13. The method of claim 10, further comprising, after said step of placing, the step of vertically folding the body of the T-shirt over onto itself a small, preselected amount.

14. The method of claim 10, further comprising the step of printing a fortune message on the T-shirt.

15. A T-shirt product made according to the method of claim 14.

16. The method of claim 10, further comprising, after said step of closing, the step of acutely folding the clam-shell.

17. The method of claim 12, further comprising, after said step of placing, the step of vertically folding the body of the T-shirt over onto itself a small, preselected amount; the step of printing a fortune message on the T-shirt; and after said step of securing, the step of acutely folding the clam-shell.

18. A T-shirt product made according to the method of claim 17.

19. A method for configuring a T-shirt to resemble a fortune cookie, the T-shirt having a body, the body having a trunk portion, a waist portion and a waist end, the T-shirt further having a first sleeve, a second sleeve and a neck, said method comprising the steps of:

printing a fortune message on a selected T-shirt;

placing the T-shirt flat upon a surface;

selectively orienting the first and second sleeves thereof in one of an outstretched orientation wherein the first and second sleeves are opposingly outstretched on the surface and a folded orientation wherein the first and second sleeves are folded over onto the body of the T-shirt;

gathering inwardly the trunk portion of the body while the waist portion of the T-shirt is left ungathered;

rolling the T-shirt starting from the neck toward the waist portion;

opening and wrapping the waist portion around the body to thereby form a clam-shell appearance to the T-shirt; and closing and securing together the waist end of the T-shirt.

20. A T-shirt product made according to the method of claim 19.

* * * * *